United States Patent [19]

Terlizzi, Jr. et al.

[11] 4,453,996

[45] Jun. 12, 1984

[54] PROCESS OF MAKING A BALLET TOE SHOE

[75] Inventors: Nicholas Terlizzi, Jr., North Haledon; Donald Terlizzi, Paquannock, both of N.J.

[73] Assignee: Ballet Makers, Inc., Totowa, N.J.

[21] Appl. No.: 524,243

[22] Filed: Aug. 18, 1983

Related U.S. Application Data

[62] Division of Ser. No. 281,947, Jul. 10, 1981, Pat. No. 4,412,393.

[51] Int. Cl.[3] ..... A43B 3/00; A43B 23/00; A43C 13/14; A43D 9/00

[52] U.S. Cl. ..... 156/227; 36/113; 156/242; 156/245; 156/257; 264/244; 264/259; 264/271.1; 264/272.15; 264/275

[58] Field of Search ..... 156/227, 242, 245, 257; 264/244, 251, 259, 271.1, 272.15, 275, 279.1; 12/146 R, 146 C; 36/68, 69, 77 R, 77 M, 107, 108, 113

[56] References Cited

U.S. PATENT DOCUMENTS

| | | | |
|---|---|---|---|
| 1,813,561 | 7/1931 | Capezio | 36/113 |
| 2,467,388 | 4/1949 | Kamborian | 264/244 |
| 3,238,089 | 3/1966 | Griswold | 264/244 |
| 3,315,317 | 4/1967 | Winkler | 264/244 |
| 4,026,046 | 5/1977 | Clark et al. | 36/113 |
| 4,199,878 | 4/1980 | Wössner | 36/113 |

*Primary Examiner*—Caleb Weston

*Attorney, Agent, or Firm*—Ostrolenk, Faber, Gerb & Soffen

[57] ABSTRACT

A ballet dancer's toe dancing ballet shoe is designed and manufactured more simply than conventional ballet toe shoes. A sole supporting shank of the toe shoe has a tip flap at the front thereof which may be folded up to define the front panel of the completed ballet toe shoe. The shank is applied to a male mold member which is inserted into a female mold member cavity and resin is inserted into the space between the mold members for defining a toe box support frame in which the inserted portion of the shank and tip flap are embedded. The shank is comprised of a leather-like material. The completed combination of the shank and toe box support frame are removed from the mold members. A ballet toe shoe upper is fastened to the shank and over the exterior and in the interior, as well, of the toe box support frame. The space between the mold members is greatest toward the interior of the cavity and gradually diminishes toward the exterior of the cavity, thickening and giving greater strength to the front of the toe shoe than to the rear portion of the toe box. The shank and resin combination eliminates intricate processes and skilled labor now required to manufacture toe shoes. At the same time, the desired properties of varying degrees of stiffness of the shoe upper and of proper support for the dancer's foot are maintained.

7 Claims, 8 Drawing Figures

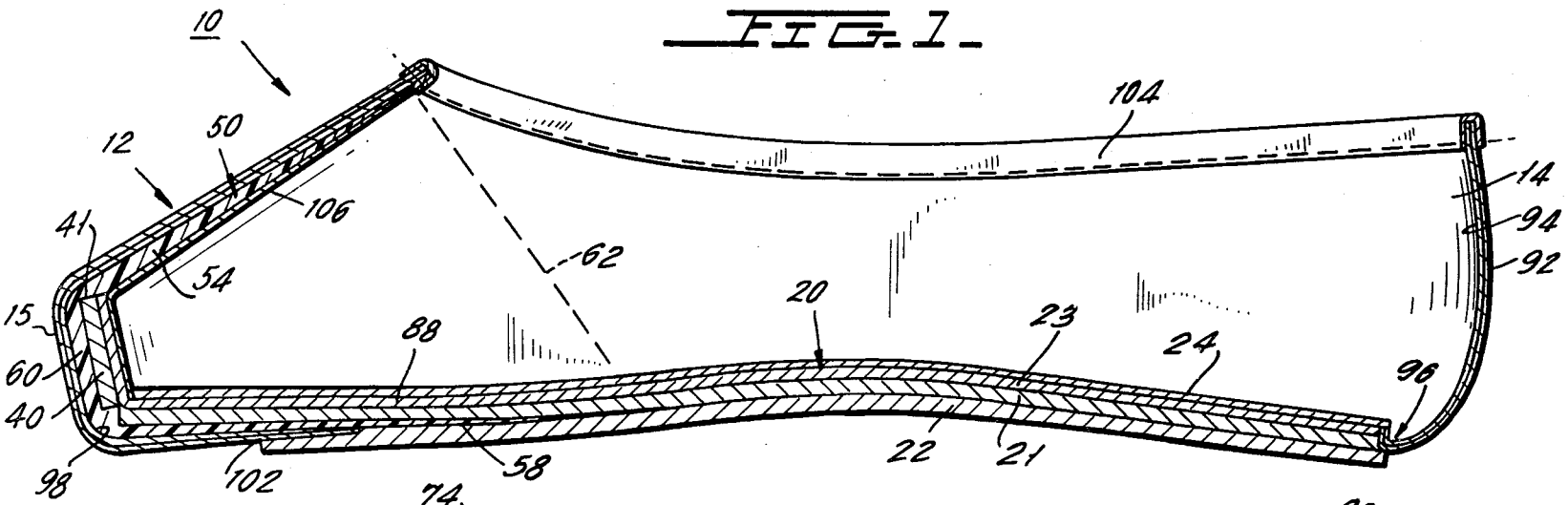
FIG. 1.
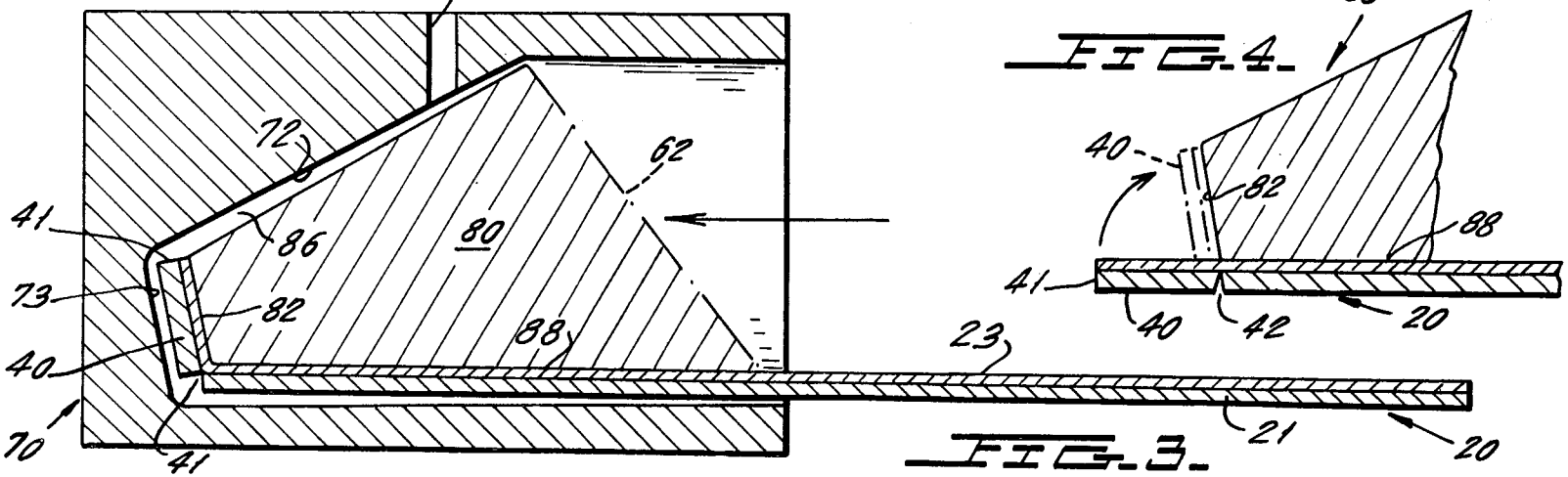
FIG. 3.
FIG. 4.

20
21
23
32
34
36
38
40
41
42
50
52
54
56
58
60
62

110
112
114
122
120
116
118

110
128
126
112
114
116
118
122
132
130
120

PROCESS OF MAKING A BALLET TOE SHOE

This is a division of Ser. No. 281,947, filed July 10, 1981, now U.S. Pat. No. 4,412,393.

BACKGROUND OF THE INVENTION

The present invention relates to a ballet toe shoe and to a process for manufacturing same, and particularly to a ballet toe shoe having a toe box of sufficient strength for a ballet dancer to dance on her toes.

A ballet toe shoe is a shoe generally comprising a soft upper which wraps around the dancer's foot, a stiff shank on which the dancer's foot rests and which extends from the toes past the sole back to the heel, possibly an outer sole beneath the shank and a stiff toe box at the front of the upper terminating at a substantially rigid panel at the front of the toe shoe. Fabrication of a ballet toe shoe typically requires the manual labor of a skilled craftsman who also must have considerable strength, as explained below. The labor and training costs for skilled craftsman are obviously quite high. Furthermore, the manufacture of a ballet toe shoe having the various stiffness characteristics mentioned above has previously required many steps, as described below. A ballet toe shoe which is simpler to fabricate and which would not require skilled craftsmen yet would have the characteristics described and a process of more simply manufacturing such a ballet toe shoe would provide a significant improvement in this art.

A summary review of the procedures now followed in manufacturing a ballet toe shoe adapted for toe dancing will demonstrate the craftsman's skills now necessary in fabricating the toe shoe.

The ballet dancer's toe shoe typically has a decorative exterior appearance, e.g. it is of satin material on the outside. The material of the upper of the toe shoe is produced as a three layer arrangement, with the outer layer being the satin layer and the inner layers being fabric, e.g. cotton stiffening layers. The three layer material is in a somewhat curled up condition, shaped for eventually defining the upper.

The material is laid down, outer decorative layer up, and the two top layers are lifted or peeled back leaving the bottom layer. Cement adhesive is applied to the bottom layer. Then a thin, gauze-like layer of material, sized and shaped to cover the toe box of the toe shoe is applied on the bottom layer. Next, a felt material piece, sized about the size of the tip of the toe shoe on which the ballerina toe dances, is adhered on the gauze layer where the front tip of the toe shoe will be. Thereafter, another gauze layer, of the size of the first gauze layer, is adhered over the felt layer and the first gauze layer. These layers rigidify the toe box when the adhesive cures.

One of the results of manually laminating individual sheets of stiffening layers in the upper of the toe shoe is that the desired stiffness characteristics of the upper, moving forward over the toe box and terminating at the stiff tip at the front of the toe box, can be obtained by these layers laid down in the toe box, while no additional layers are applied in the material of the ballet toe shoe upper away from the toe box.

Next, the peeled back intermediate layer of the upper is laid down and cemented in place over the additional layers. Finally, the outer layer is laid down and cemented in place. The material for the upper is somewhat curved up ready to be applied to a shoe last. The outer decorative layer of the material is on the inside, for now, rather than on the outside.

An outer sole for the ballet toe shoe is placed on a shoe last and is temporarily attached to the last, e.g. by stapling. The above described cemented together layered upper in the somewhat curved up, outer layer on the inside, condition, is pulled over the last, with the outer layer facing in to the last. The material is pulled over the last until it meets the outer sole which is sitting on the last, and when the upper has been shaped around the last, it is attached to the sole. The material is appropriately pleated at the front of the toe shoe and a cord on the material is pulled tight and tied so that the edge of the material is drawn in around the last to meet the front of the sole. The toe shoe is readied for stitching by trimming off excess material. The toe shoe is stitched on a stitching machine. Excess material past the stitching is trimmed off. The temporary tacking of the sole to the last is removed and the toe shoe is removed from the last by being peeled off back to front. This turns the toe shoe inside out so that the outer layer of the upper is now on the outside and the sole is on the outside. The toe shoe is again placed on the last, and because the toe shoe is so tightly fitted to the last, it must be shoe-horned onto the last. The final shaping of the still soft toe box over the last can now be done, by tapping and by smoothing rubbing strokes, because the adhesive on the layers of the material at the toe box has not yet cured. Once the soft toe box has been shaped, the toe shoe is again removed from the last.

A toe shoe shank has cement applied to it and is inserted into the toe shoe and laid on and cemented to the sole. The toe shoe is yet again shoe-horned onto the last for a final touch-up and shaping of the toe box. After some hours, the adhesive at the toe box is finally cured and the toe shoe can be removed from the last. The underside of the front end of the shank has a thickened section to fill in the area of the vicinity of the pleats at the front of the toe shoe.

The foregoing procedure for making a toe shoe requires four significant pulling or stretching steps, namely first placing the laminated fabric material for the upper on the last and bringing the material to the sole for attachment, pulling the upper off the last while at the same time reversing the toe shoe inside out after the upper has been attached to the sole, applying the upper on the last for initial shaping, removing it from the last, and applying it yet another time to the last for further shaping of the toe box. A strong skilled craftsman is usually needed. Considerable time is used. Failure to exert proper and sufficient pull during any step will ruin the entire shoe.

There was an experiment in the prior art to produce a ballet toe shoe using a different technique. A one-piece resin material molding was made to define both the shank and the frame or form for the toe box of the toe shoe. Thereafter, the fabric upper was simply shaped over the preformed toe box and attached on the shank to produce a completed toe shoe. The number of steps in manufacture of a ballet toe shoe were thereby drastically reduced. However, this technique had a number of drawbacks. A ballet toe shoe is "broken in" and becomes comfortable to the wearer because when leather or a leather like product is used for the shank, the shank tends to mold itself to the wearer's foot during repeated wearings, making the toe shoe more comfortable over time. The resin or plastic molding shank of this prior ballet toe shoe typically had resilient "memory" and would return to its original shape when deformed, so that the shank could not permanently adapt to and conform to the wearer's foot and would not become comfortable.

SUMMARY OF THE INVENTION

Accordingly, it is the primary object of the present invention to simplify the manufacture of a ballet toe shoe.

It is another object of the present invention to provide a ballet toe shoe having the toe box qualities of a conventionally manufactured ballet toe shoe.

It is a further object of the invention to provide a ballet toe shoe which has the wearer comfort characteristics of a conventionally manufactured ballet toe shoe.

It is thus another object of the invention to provide a ballet toe shoe wherein the shank is adapted to mold itself to the wearer's foot through use, for increasing wearer comfort over time.

According to the present invention, the ballet toe shoe comprises a molded, such as a cast, frame or support for the upper of the toe shoe at the toe box of the toe shoe, coupled with a leather or leather-like, e.g. a leather board shank for the toe shoe. The material for covering the toe box and extending past the shank and also for defining the upper of the toe shoe may be of constant thickness and have a constant number of layers, less than three, for example, without the necessity of adding additional layers near the toe box. The leather or leather-like shank extends along the underside of the foot to the front of the toe shoe and is bent up at the front of the toe shoe to define the flattened generally vertical front end of the toe shoe on which a ballet dancer raises herself when dancing on her toes. The shank, therefore, is a continuous element extending under the foot and then up at the front of the toe box. The resin of which the toe box frame is fabricated is molded over and thereby integrated with and strengthens and rigidifies the front and the upwardly bent portion of the shank. The shank, in turn, rigidifies the molded frame of the toe box, giving the toe box and the front of the toe shoe the requisite stiffness.

The manufacture of the toe box frame and shank assembly can be automated and/or can be done by less skilled workers than are needed to conventionally manufacture ballet toe shoes and the manufacture can be done in less time and at a fraction of the cost of conventional manufacturing.

The method of producing the assembly of the shank and toe box support is now described. A male mold member, i.e. a shoe last, is fabricated, which generally conforms to the last of the ballet toe shoe, but only at the region of the front of the toe shoe that is at the toe box. There is also a female mold member, i.e. a molding cavity, shaped to generally conform to the male mold member.

The shape of the male mold member does not precisely conform to the shape of the shoe last. It is desirable for the toe box frame to be stiff and rigid at the front of the toe shoe but to become gradually somewhat more flexible moving rearwardly of the toe box. Conventionally, this is accomplished by reducing the number of additional layers applied between the layers of material of the upper, moving rearwardly of the tip of the toe shoe and then again rearwardly of the toe box. With the invention, on the other hand, the mold cavity is shaped so that the spacing between the toe box last and the wall of the mold cavity gradually decreases moving rearwardly of the toe box frame, so that the molded resin layer toward the rear of the toe box frame is thinner and thus more flexible than it is at the front of that frame.

The shank of the ballet toe shoe is a conventional leather, leather-like or what is known as a leather board shank. The front end of the shank does not terminate at the front end of the toe shoe, as is conventional, however. Instead, there is an additional section or tip flap at the front of the shank which is intended to be folded up and is shaped so that when it is folded up, it has the edge profile of the flat portion conventionally found at the front of the toe dancer's ballet toe shoe. The front end portion of the shank may be scored or otherwise weakened to define a line at which the tip flap is folded up. This weakening does not adversely affect the toe shoe because the resin of the toe box frame stiffens the shank at the front of the toe shoe and particularly at the fold.

The shank is placed on the surface of the shoe last which is at the side of the last that corresponds to the sole of the toe shoe. The last is grooved or otherwise provided with a guide means for properly positioning the shank on the last. The tip flap projects forward beyond the front end of the shoe last. The shank on the last is pushed into the mold cavity. The end wall of the mold cavity contacts and bends up the flap at the end of the shank into the correct position.

Using a conventional resin applying technique, an appropriate resin is inserted into the mold. One example of a resin suitable for this purpose is Eccothane, a proprietary product #LN79161, which is sold worldwide by the Emerson and Cumming Chemical Division of W. R. Grace Company. Typically, this resin is inserted at an elevated temperature and pressure, sets in a short time and is thereafter cured. The resin has the characteristic that it hardens rigidly if the layer is thick enough, as it is toward the front of the toe box, but the resin layer has an increasing degree of flexibility toward the rear of the toe box as the thickness of the resin layer is gradually reduced. The variations in the thickness of the resin layer arise due to the cooperative shaping of the last and the mold cavity. After the resin has been inserted into the mold cavity, the shank and last are left in the cavity until the resin sets, which typically takes less than one minute. The last is then pulled out and the resin cures in air for a few minutes. Curing is then completed in any desired manner which is appropriate for the resin selected.

The use of a leather-like shank with the fold up tip flap has a number of benefits. First, the bent up tip flap itself is quite rigid, thereby rigidifying the front of the toe box. Secondly, because the tip flap of the shank is integral with the shank and is a continuation thereof, there is a smooth flow of the shank into the folded up tip which improves wearer comfort. Third, the shank tip flap itself reduces the need for a lot of plastic resin at the tip of the slipper, because the shank tip flap provides the tip which would otherwise have to be of the resin material. Fourth, the resin material of the enclosing toe box at the front of the toe shoe holds the folded up tip flap of the shank in the upraised condition and fills in the area around the folded up tip flap to help it upraised. The ballet toe shoe must be stronger at the front of the toe and at the shank, and the shank here provides the needed strength at these locations.

The completed unit of the leather or leather-like shank and resin toe box frame is now set on the ballet toe shoe last. An appropriate shoe upper of cloth, such as satin, or even leather, having uniform thickness, and which may be of fewer than the three layers required in the prior art, is draped on the shank and is folded over the toe box and then is cemented at the under-side of the shank. The material of the upper is then pulled over the last or form and is then fastened to the shank. Thereafter, an outer sole is attached, if desired. In the prior art, in contrast, the sole is applied to the material of the upper first and the shank is applied later.

The foregoing construction of the ballet toe shoe and the foregoing process of making the same has a number of benefits. Obviously, there is a considerable reduction in the number of steps that must be performed, and thus a ballet toe shoe can be manufactured more rapidly than conventionally. There is uniformity in each ballet toe shoe, because the strengthened portions thereof, particularly the shank and the toe box, will always be uniformly fabricated, again without requiring the skill of a craftsman to accomplish this. The need for skilled labor in producing a ballet toe shoe is avoided. The stretching and pulling steps required in the prior techniques of manufacture, which require strong as well as skilled craftsmen, are also avoided. Further still, the material used to define the upper of the ballet toe shoe need not be the three layer material conventionally required, as the step of applying additional laminations for defining a more rigid toe box is no longer needed. Moreover, the additional layer conventionally required under the front end portion of the shank is not now needed. Finally, wearer comfort experienced with conventionally manufactured ballet toe shoes is maintained.

The foregoing and other objects and features of the present invention will become apparent from the following description of a preferred embodiment of the invention taken in conjunction with the accompanying drawings.

BRIEF DESCRIPTION OF THE DRAWINGS

FIG. 1 is a longitudinal, elevational, cross-sectional view of a ballet toe shoe according to the present invention and produced according to the method of the invention;

FIG. 3 shows an assembled mold arrangement for fabricating the shank and toe box support frame combination which serves as the foundation for the ballet toe shoe according to the invention;

FIG. 4 illustrates the toe portion of the shank and the associated mold member;

DESCRIPTION OF THE PREFERRED EMBODIMENT

Figures 2, 5, 6:
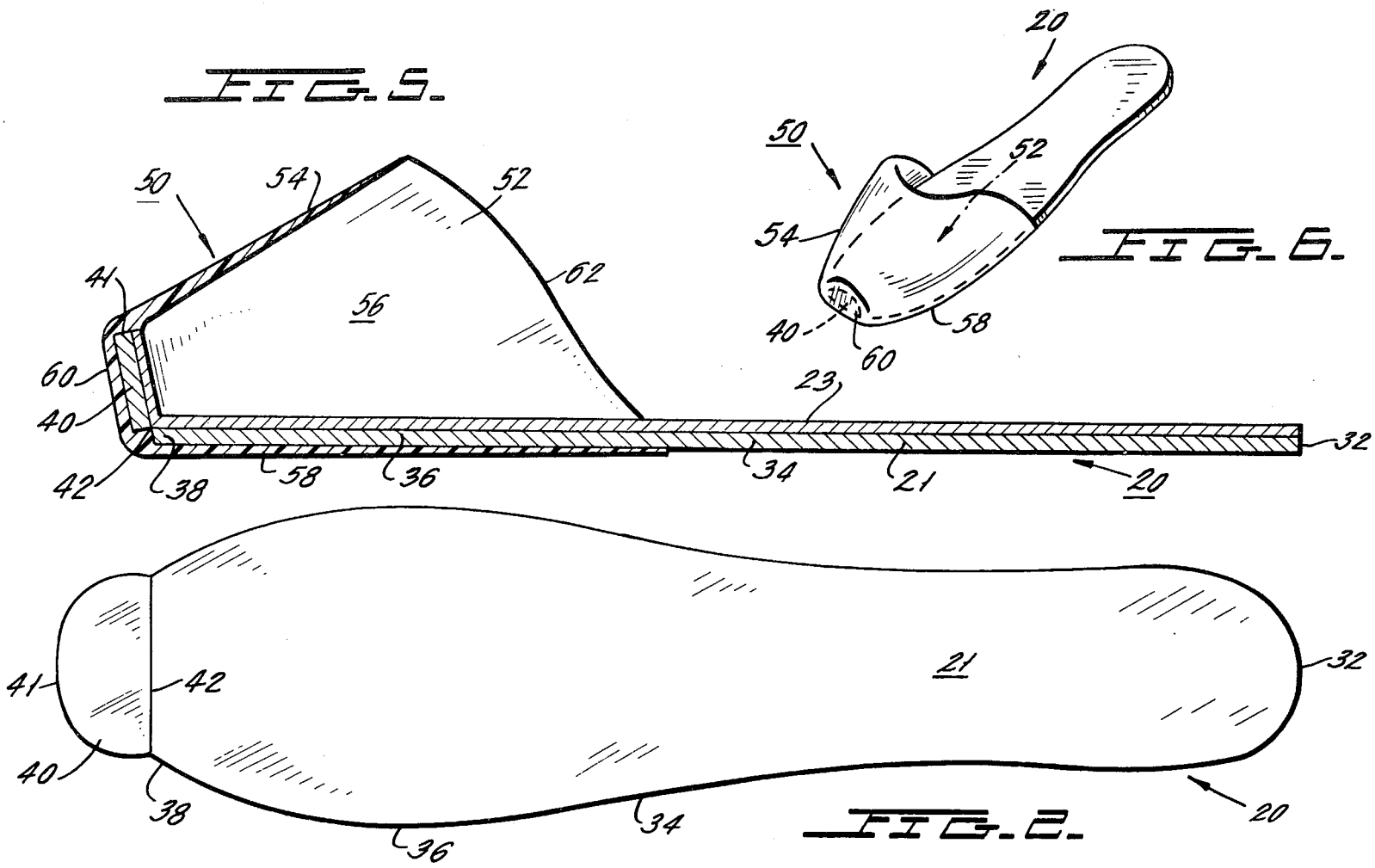
FIG. 2 is a bottom plan view of the shank of the ballet toe shoe according to the present invention.
FIG. 5 is the same type of view as FIG. 1 showing the completed shank and toe box support frame combination.
FIG. 6 is a perspective view of the combination of FIG. 5.

The ballet toe shoe 10 shown in FIG. 1 includes a toe box region 12, which covers the toes and the area of the foot behind the toes, an upper 14 for covering the entire foot, a shank 20 disposed beneath the wearer's heel and sole and extending forward to and past the toes and to which the upper 14 is stitched, an outer sole 22 beneath the shank and perhaps an insole 24 inside the toe shoe provided for wearer comfort. The toe box region 12 is relatively stiff, as compared with the relatively more soft upper 14. Ballet toe dancers often dance up on the front or tip of their ballet toe shoes. Thus, the front panel or tip 15 of the ballet toe shoe is quite rigid, so that it will support the entire weight of the ballet dancer without bending or breaking.

With reference to FIGS. 2 and 5, shank 20 is comprised of two laminated together, thin pieces 21, 23 of leather, or a leather-like material known as leatherboard, or other appropriate material which has sufficient strength to support the wearer's sole and heel comfortably and which is flexible enough to bend as the wearer's foot flexes. The shank has the general edge profile of the underside of a foot. Starting at the rear of the shank there is the heel supporting section 32, the narrowed waist 34 which passes beneath the arch, the section 36 beneath the metatarsal bone and the front 38 beneath the toes. Forward of the front 38 of the shank, there is a separate tip flap 40 which is integrated at the weakening or fold 42 with the rest of the shank. The fold 42 is defined by a score line 42 which cuts across the bottom layer 21 of the shank and weakens the shank so that it could be folded up there. The generally rounded edge profile of the tip flap is selected to generally conform to the shape of the front tip 15 of the completed ballet toe shoe, whereby the tip flap helps define the profile of the front end of the ballet toe shoe.

The shank 20 is integrally molded to the toe box support frame 50 in a molding process described below. The toe box support frame surrounds the toes and generally surrounds the metatarsal region of the foot. The frame 50 defines the cavity 52 into which the front of the wearer's foot is inserted. The toe box support frame 50 includes the top wall 54 over the top of the foot, the side walls 56 around the side of the foot and the bottom 58 which passes beneath the shank 20. At the forward end of the toe shoe, the toe box support frame front 60 covers the exterior side of and is integrated with the tip flap 40 of the shank, whereby the relatively rigid tip flap 40 supports the front of the toe shoe and the front 60 of the toe box support frame, in turn, supports the tip flap in a fixed position. The material of the toe box support frame also fills in the weakened area of fold 42, preventing the tip flap 40 from flexing with respect to the shank once the toe box support frame has been formed. The rear edge 62 of the support frame 50 defines the entrance opening into the cavity 52.

The support frame 50 is comprised of a resin material, which has been described in an earlier section hereof. As shown in more exaggerated form in FIGS. 1 and 5, the resin material of the support frame 50 is not of uniform thickness from the front 60 to the rear edge 62. The changing thickness is present not only on the top 54 of the toe box support frame but along the side walls 56. The material of the support frame 50 nearer the rear edge 62 is thinner and more flexible for wearer comfort. The front 60 of the support frame, in contrast, is thick enough to be quite rigid so that the toe dancer can lift herself onto the front end 15 of the ballet toe shoe 10 without the front of the toe shoe, and particularly the front 60 of the support frame and the tip flap 40, flexing. Although a uniformly graduated change in wall thickness of the support frame is illustrated, the thickness changes may be stepped, so long as the support frame is more flexible toward the rear and more rigid toward the front of the toe shoe.

In order to form the shank and toe box support frame combination, a mold is provided. The mold is comprised of the female mold member 70 which includes a body having a mold cavity 72 formed in it. A conventional resin inlet 74 for the molding resin communicates into the cavity 72. The cavity 72 is defined by internal walls which are profiled to the external shape of the toe box support frame 50, which is shown in FIGS. 5 and 6. The inward, forward end wall 73 in the cavity 72 is flat and is also inclined to define an abutting surface to be abutted by the tip flap 40 of the shank, as described below and for helping to position the tip flap 40 for molding in an upstanding orientation.

A separate male mold member 80, in the shape of the last or form for the toe box region of the ballet toe shoe is externally profiled to the desired internal shape of the side walls of the cavity 52 of the toe box support frame 50. The front wall 82 of the male mold member is flat and inclined at the orientation that the tip flap 40 of the shank desirably attains. It is also generally parallel to mold wall 73. As shown in FIG. 3, the walls of the cavity 72 and the exterior profile of male mold member 80 are cooperatively selected to define a resulting resin cavity 86 having a larger width toward the front of the toe box support frame than toward the rear thereof for producing the desired thickness of the toe box support frame walls, described above.

The underside of the male mold member 80 includes a shallow groove 88 defined therein, the edge profile of which conforms to the edge profile of the shank 20, whereby the shank is properly positioned along the male mold member through its emplacement within the groove 88. The groove 88 is shaped so that the fold 42 in the shank will be located at the front wall 82 of the mold member 80, which enables the shank to be folded up.

The male mold member with the shank in the groove 88 and with the tip flap 40 down in the solid line position of FIG. 4 is inserted into the cavity 72. Appropriate registry means (not shown) between the male and female mold members assures their proper relative positions and orientations for defining the space 86 between the male and female mold members. When the male mold member is nearly fully installed in the female mold member, the leading end 41 of the tip flap 40 abuts the end wall 73 of the female mold member and the tip flap 40 is folded up at the fold 42 to the upwardly folded condition shown in FIGS. 3 and 4.

After the male mold member 80 with the shank 20 in place has been fully installed in the female mold member 70, resin is poured into the space 86 through the inlet 74 and the resin eventually fills the cavity 86 around the male mold member 80 around and beneath the shank 20 and in front of and outside of the tip flap 40. One technique for shaping the rear edge 62 of the support frame so that it is inclined as shown in FIG. 5 is to tilt the mold member 70 so that the horizontal generally follows the line of the rear edge 62. Other techniques for thus inclining the rear edge of the toe box support frame 62 are known to those skilled in the molding art. Furthermore, after the toe box support frame and shank combination have been molded, the rear edge can be shaped by abrading, etc.

The mold members are left together as shown in FIG. 3 until the resin has set. Then the male mold member is removed and the toe box support frame is cured, either with the male mold member 80 in place or with it removed from the toe box support frame, as the particular molding resin used may require. An integral shank and toe box support frame combination as shown in FIGS. 5 and 6 has thereby been molded.

With reference to FIG. 1, the remainder of the ballet toe shoe is now assembled to the aforesaid combination. The upper 14 is comprised of a double layer of material, including the decorative outer satin layer 92 and an inner soft cotton layer 94 which is comfortable to the wearer's foot. It is not necessary that the upper have three layers, as required in the prior art, described below. The shank and toe box support frame combination are placed on a last and the shoe upper 14 is conventionally shaped on the last and then attached to the shank at 96 by stitching. The upper is wrapped over the toe box support frame, wrapped around the front thereof, is pleated at 98 beneath the shank and is also stitched to the shank at 102. A welt 104 around the foot opening of the upper strengthens the upper and defines the top of the toe shoe. An extra layer 106 of comfortable cotton material may be stitched at the front portion of the upper for passing around the inside of the toe box support frame against scraping on the interior surface of the toe box support frame.

A leather outer sole 22 is disposed beneath the shank of the toe shoe. A thin, flexible, comfortable inner sole 24 is disposed inside the toe shoe on top of the shank, and the inner and outer soles are glued into position. The ballet toe shoe is now completed. The process of manufacture of this ballet toe shoe has been described in an earlier section hereof. It is relatively simple and requires fewer skilled personnel than are required for conventional manufacture of ballet toe shoes.

DESCRIPTION OF THE PRIOR ART

Figures 7, 8:
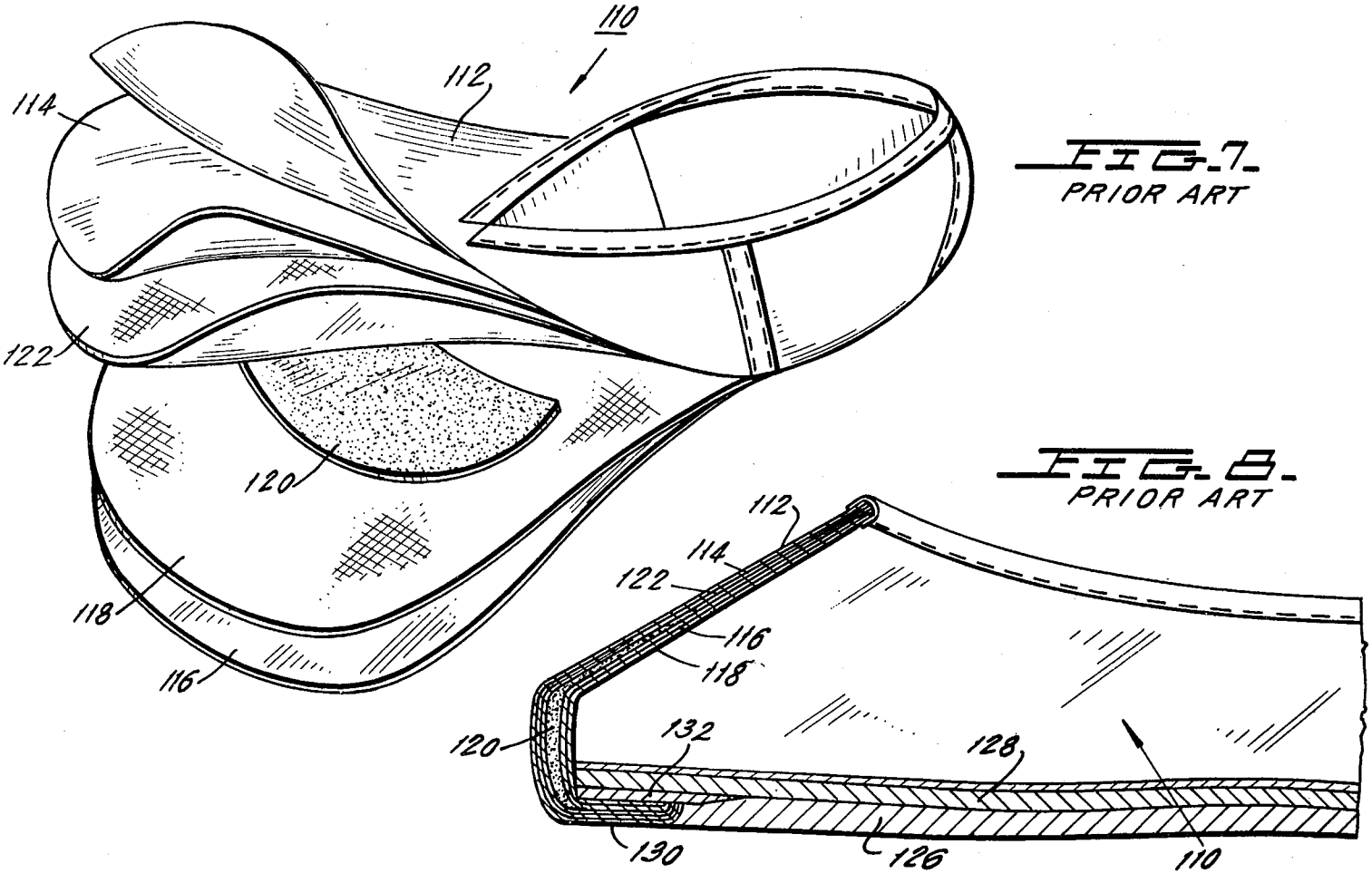
FIG. 7. PRIOR ART
FIG. 8. PRIOR ART
FIG. 7 illustrates an upper used in producing a bellet toe shoe according to the prior art.
FIG. 8 is an elevational, longitudinal, cross-sectional view of a ballet toe shoe according to the prior art.

FIGS. 7 and 8 illustrate the different method used in conventionally fabricating a ballet toe shoe.

No separate toe box support frame is manufactured. Instead, the toe shoe upper is adapted to provide the toe box region support. The toe shoe upper 110 shown in FIG. 7 is comprised of three basic layers, the decorative, outer layer 112 of satin, or the like, the intermediate layer 114 of a soft, non-decorative fabric, such as cotton, and the inner, foot contacting layer 116 of a soft, non-decorative fabric, such as cotton. The upper comprised of these three layers is generally curled up, with the outer layer 112 on the inside of the curled upper. The three layers 112, 114, 116 together are quite flexible. To define the more rigid toe box region of the ballet toe shoe, a craftsman pulls back the decorative layer 112 and the intermediate layer 114, exposing the top of the bottom, innermost layer 116. A piece of fabric 118, e.g. a gauze-like material, and cut out to have an external profile generally like the upper of the ballet toe shoe around the toe box region has adhesive applied to it. It is then adhered to the layer 116. A small pad 120 of felt, or the like, is adhered by adhesive to the layer 118 at the location where the front tip of the ballet toe shoe will eventually be defined and that piece of felt 120 is shaped to cover the tip of the ballet toe shoe and a little distance rearwardly from the tip, which is the portion of the ballet toe shoe which must be more rigid. On top of the layer 120 and the gauze layer 118, another layer 122 having the profile generally of the layer 118 is attached by adhesive. The layers 118 and 122 therefore cover the toe box region of the toe shoe and the smaller felt layer 120 covers the front tip and the area slightly rearwardly of the front tip of the toe shoe.

Next, the intermediate layer 114 is adhered over the layer 122 and finally the decorative layer 112 is adhered to the layer 114.

The multiple step technique of completing the ballet toe shoe, once the upper has been fabricated as described just above, is described in considerable detail in an earlier section hereof and the fabrication techniques are not, therefore, repeated here.

With reference to FIG. 8 which shows the structure of a completed prior art ballet toe shoe, the upper has been attached to the outer sole 126, but not to the shank 128. The material of the upper is brought forward of the tip 120 of the toe shoe and is pleated at 130 beneath the tip and is fastened to the outer sole. The shank 128 is fastened inside the toe shoe over the outer sole. At the tip of the toe shoe, the shank includes the extra layer 132 that fills up the area beneath the pleats 130. The provision of and attachment of such additional piece of the shank is not needed with the invention, because the shank extends forward past the toes and then is folded up to extend in front of the toes.

The prior art ballet toe shoe has more and different layers than the ballet toe shoe of the invention. As described earlier herein, the process of in manufacturing a ballet toe shoe according to the invention is considerably simpler than the method of the prior art. The invention saves time in manufacture and avoids the need for skilled craftsmen to fabricate ballet toe shoes.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A method of making a combination of a toe box support frame and a shank for a ballet toe shoe, or the like, the method comprising:

applying a ballet toe shoe shank having a front end, with a foldable tip flap being defined on the front end of the shank, to the toe shoe sole side of a male mold member that is generally in the shape of a toe box of a ballet toe shoe, and the shank being applied to the male mold member so that the tip flap of the shank extends forward of the forward end of the male mold member;

inserting the male mold member, forward end first, into the mold cavity of a female mold member which cavity has a profile that generally conforms to the external profile of the male mold member, and the respective profiles of the male and female mold members being shaped so that there is a narrow space defined between the male and the female mold members for receiving a moldable resin material, or the like; the male mold member being inserted far enough for the tip flap at the front of the shank to contact the interior of the female mold member for then folding up the tip flap over the front end of the male mold member, whereby the tip flap is then in position to be at the front tip of the toe box support frame;

applying resin in the space between the male and the female mold members and also applying the resin over the tip flap, and allowing the resin to set for thereby defining the toe box support frame and for integrating the shank and the support frame; and removing the toe box support frame with the shank integrated therewith from the mold members.

2. The method of claim 1, wherein the profiles of the male and the female mold members are respectively so shaped that the space between the mold members is greater near the forward end of the inserted male mold member and diminishes rearwardly, whereby the resin layer is thicker toward the front of the support frame at the tip flap and is thinner away from the front of the support frame.

3. The method of claim 1, wherein the shank and the tip flap are integrated as a single unit and wherein prior to applying a shank to the male mold member, weakening the shank at the front end thereof at the tip flap for enabling the tip flap to be folded up in the female mold member.

4. The method of claim 1, wherein the shank is comprised of leather-like material.

5. A method of making a ballet toe shoe, comprising first making a combination of a toe box support frame and a shank according to the method of claim 1 and thereafter attaching a ballet toe shoe upper to the shank and passing the upper over the exterior of the toe box support frame for defining a foot covering upper of the ballet toe shoe.

6. The method of claim 5, further comprising also attaching the upper on the interior of the toe box support frame.

7. The method of claim 5, further comprising attaching an outer sole beneath the shank.

* * * * *